United States Patent [19]

McNair, Jr. et al.

[11] Patent Number: 4,746,011

[45] Date of Patent: May 24, 1988

[54] STRAPPED BALE HAVING MEANS WHICH RESTRAIN THE STRAPS THEREOF UPON SEVERING AND METHOD OF FORMING THE SAME

[75] Inventors: Samuel S. McNair, Jr., Pembroke; Robert J. Shea, Blacksburg, both of Va.

[73] Assignee: Celanese Corporation, New York, N.Y.

[21] Appl. No.: 893,742

[22] Filed: Aug. 6, 1986

[51] Int. Cl.[4] ..... B65B 27/12; B65D 71/02

[52] U.S. Cl. ..... 206/83.5; 53/399; 100/2; 100/912; 206/442

[58] Field of Search ..... 53/399; 100/1, 8, 14, 100/34, 912, 2; 206/83.5, 442, 443, 597

[56] References Cited

U.S. PATENT DOCUMENTS

| | | | |
|---|---|---|---|
| 443,619 | 12/1890 | Orr | 206/83.5 |
| 701,970 | 6/1902 | Wales | 206/83.5 |
| T893,007 | 12/1971 | McCormick | 53/449 |
| 1,193,506 | 8/1916 | Brown . | |
| 1,367,650 | 2/1921 | Angier . | |
| 1,468,130 | 9/1923 | Angier | 206/83.5 |
| 2,026,282 | 12/1935 | Leguillon . | |
| 2,324,745 | 7/1943 | Weber . | |
| 2,658,614 | 11/1953 | Van Patten . | |
| 2,820,282 | 1/1958 | Schneider, Jr. . | |
| 2,908,121 | 10/1959 | Enow, Jr. . | |
| 3,015,916 | 1/1962 | Denton . | |
| 3,118,536 | 1/1964 | Allen . | |
| 3,253,379 | 5/1966 | Foradora . | |
| 3,330,409 | 7/1967 | Jorgensen | 100/1 |
| 3,351,185 | 11/1967 | Blumer . | |
| 3,390,765 | 7/1968 | Grant . | |
| 3,420,159 | 1/1969 | Barnickel . | |
| 3,809,223 | 5/1974 | Kendall . | |
| 3,824,758 | 7/1974 | Hart et al. . | |
| 3,906,591 | 9/1975 | Boiardi . | |
| 4,079,566 | 3/1978 | Stoecklin . | |
| 4,343,132 | 8/1982 | Lawless, Jr. . | |

FOREIGN PATENT DOCUMENTS

| | | | |
|---|---|---|---|
| 2931337 | 2/1981 | Fed. Rep. of Germany | 206/597 |

*Primary Examiner*—Jimmy G. Foster

*Attorney, Agent, or Firm*—Robert J. Blanke; Forrest D. Stine

[57] ABSTRACT

A bale of goods, particularly textile goods, and method of forming the same includes covering the bale of goods with a cover and then strapping the bale with at least one tensioned strap which encompasses the bale. A restraining tape extends generally transversely over the strap and is affixed (preferably by means of adhesive) to the strap and to portions of the cover laterally adjacent to the strap. The restraining tape thereby positionally and attachably secures the strap to the bale and defines a zone of the strap in which the strap may be severed to minimize outward lashing thereof thereby promoting a greater measure of safety to personnel.

10 Claims, 2 Drawing Sheets

STRAPPED BALE HAVING MEANS WHICH RESTRAIN THE STRAPS THEREOF UPON SEVERING AND METHOD OF FORMING THE SAME

FIELD OF INVENTION

The present invention generally relates to strapped bales of goods, articles, or the like intended for shipment in commerce and, more particularly, to a strapped bale of textile material, for example, filamentary tow.

BACKGROUND AND SUMMARY OF THE INVENTION

It is customary for numerous articles of commerce to be shipped in bale form. Since a bale is of a generally square parallelepiped shape, such a form is conducive to various modes of shipment. In particular, the textile industry has traditionally shipped bales of textile materials, such as, staple or filamentary yarns, fibers, tows, or the like, in bale form whereby the material is compressed, covered by a suitable covering member and retained in a compressed state by means of tensioned steel straps encompassing the bale along its peripheral surfaces in the length, width and depth dimensions thereof. Compression of such textile materials further aids in their shipment in commerce inasmuch as the bales then occupy less space.

A problem exists, however, that since the bales are maintained in a compressed state by virtue of the steel straps, the straps themselves will be under a significant amount of tension due to the tendency of the compressed bale to relax and/or due to the inherent springiness of the steel straps themselves. In order to access the material of the bale, therefore, it is typically necessary for an operator to manually sever each steel strap. Upon severing, the tension of the strap is suddenly released thereby causing the straps to lash outwardly away from the bale. As may be appreciated, such outward lashing of the strap upon severing not only may present a physical hazard to the operator who is severing the straps (due to the sharp-edged nature of the straps) but may also be a hazard to persons in the vicinity of the bale since the straps may have sufficient force to recoil to an opposite side of the bale. Any person on the opposite side of the bale during severing of the straps therefore may be struck with one or more of the straps causing potentially serious injuries.

SUMMARY OF THE INVENTION

It is one object of the present invention to provide means which positionally restrains the strap and which defines a "safe zone" in which the steel straps of a bale may be severed so as to minimize outward lashing thereof.

This and further objects of the invention are achieved in a bale of goods having a cover for covering and containing the goods and at least one tensioned strap encompassing the periphery of the bale. A restraining tape, ribbon or the like extends generally transversely over the strap and is affixed (preferably by adhesive) to the strap and to portions of the bale cover laterally of the strap. The tape thus constitutes the means for restraining and positionally securing the strap to the bale and, moreover, defines a zone of the strap in which the strap may be severed to minimize outward lashing thereof.

A further aspect of the invention relates to a method of forming a strapped bale by covering a compressible mass of material with a cover member and then compressing the mass of compressible material to form a generally square parallelepiped shape. A peripheral surface of the cover member is encompassed with at least one tensioned strap to retain the mass in its compressed state. The strap is then positionally secured relative to the bale by transversely extending a tape over the strap and adhering the tape to the strap and to portions of the cover laterally of the strap. By means of the tape, a zone is defined in which the strap may be safely severed such that the tape restrains the strap from outward lashing movement to an extent which minimizes the risk of injury to a person who severs the strap.

Further objects and advantages of the present invention will become more clear after careful consideration is given to the detailed description of the preferred exemplary embodiments thereof which follows.

BRIEF DESCRIPTION OF THE ACCOMPANYING DRAWINGS

Reference will hereinafter be made to the accompanying drawings wherein like reference numerals throughout the various figures denote like structural elements, and wherein.

DETAILED DESCRIPTION OF THE PREFERRED EXEMPLARY EMBODIMENTS

Figure 1:
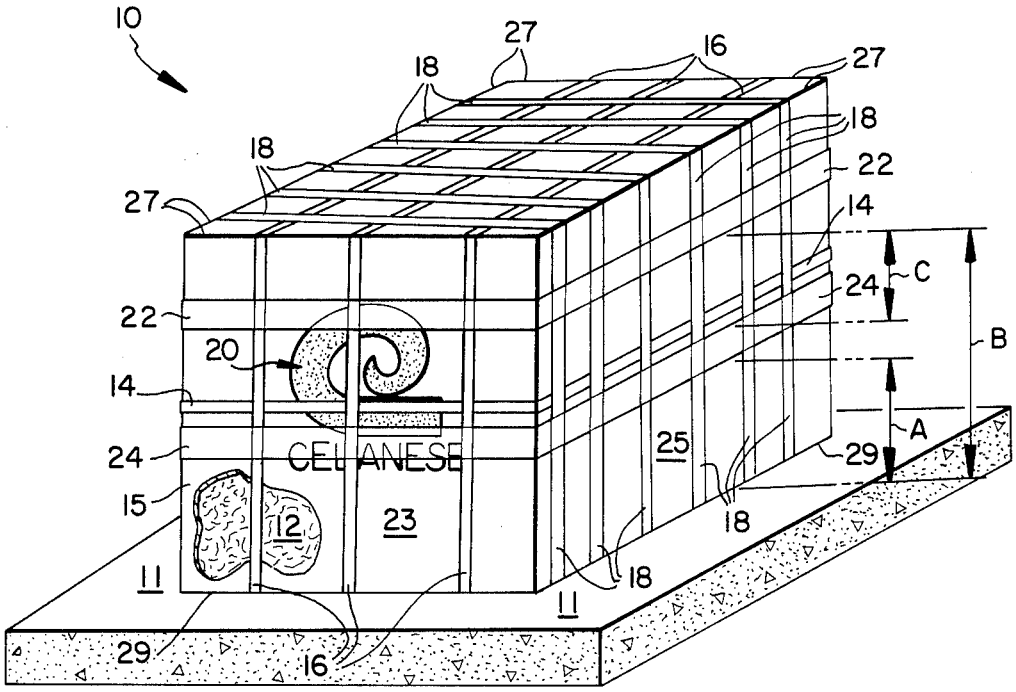
FIG. 1 is a perspective view of a strapped bale in accordance with the present invention shown resting upon a rigid support surface.

A bale 10 in accordance with the present invention is shown in FIG. 1 as resting upon a rigid concrete pallet 11 which provides a support surface for the bale 10. As is seen, bale 10 is of a generally square parallelepiped shape in that it has three pairs of opposing mutually perpendicular sides. Preferably, bale 10 contains a compressible material, such as, staple or filamentary textile materials or like goods for shipment in commerce, which goods are shown partially exposed in FIG. 1 as reference numeral 12 for purposes of clarity. Bale 10 may, for example, be formed of cellulose acetate continuous filamentary tow which is further processed and formed into filter rods for cigarettes. For purposes of discussion, the goods 12 contained in bale 10 will hereinafter referred to as filamentary tow material.

The tow material 12 of bale 10 is preferably contained within a cover member 15 which can be formed of any suitable transparent or opaque material, for example, boxboard, fiberboard, plastic sheet material, or the like. Cover member 15 may also be conveniently imprinted with indicia, such as a company's logo (generally noted by reference numeral 20 in FIG. 1), and/or with instructions regarding the handling or shipping of bale 10.

As indicated previously, since bale 10 is preferably comprised of compressed tow material 12 which facilitates its transport in commerce, straps are typically utilized to retain bale 10 in its compressed state. Such straps, as shown in FIG. 1, may consist of a girth strap 14 which horizontally encompasses the periphery of bale 10. Straps 16 may also encompass bale 10 vertically about its periphery in the depth dimension of bale 10 and are disposed substantially perpendicular to girth strap 14 with straps 18 encompassing the bale 10 vertically about its width dimension and are perpendicular relative to straps 16 and girth strap 14. Straps 14, 16 and 18 are conventionally formed of steel but may be formed of plastic which may also present physical hazards to personnel upon severing even though to a lesser extent than steel straps. The present invention therefore is particularly suited for reducing safety hazards occasioned by the use of steel straps.

Bale 10 according to the present invention is preferably provided with one or more strap restraining means which can be in the form of tape, ribbon or the like. In the embodiment of FIG. 1, two such tapes 22, 24 are depicted as horizontally encompassing the two pairs of opposing vertical sides 23, 25 of bale 10 parallel to girth strap 14 when bale 10 is resting upon surface support 11, only one side of each opposing pair of sides 23,25 being visible in FIG. 1. Each tape 22, 24 thus transversely covers portions of straps 16 and 18 vertically extending between the top and bottom edges 27 and 29, respectively, of the bale 10 along the vertical pairs of side surfaces 23, 25 thereof. Preferably, tape 22 is placed within about six inches of top edge 27 of bale 10 while tape 24 is placed within about six inches of girth strap 14.

Tapes 22 and 24 are advantageously an adhesive-backed transparent packaging tape reinforced with continuous glass yarn filaments which impart high tensile strength to the tape and also resist tearing forces in its width direction which result when the straps 16 and 18 are severed. Such a tape is about two inches in width and preferably has rubber-resin adhesive on a polyester film backing which is reinforced with continuous glass filaments. The presently preferred tape has an adhesion to steel of about 55 oz./in. width (ASTM test method D-3330), a tensile strength of about 390 lb./in. width (ASTM test method D-3759), an elongation at breakage of about 3% (ASTM test method D-3759), and a total thickness of about 0.008 inch (ASTM test method D-3652). Such a tape is commercially available from the Packaging Systems Division of 3M Corporation, St. Paul, Minn. as #891 High Performance Specialty Filament Tape.

Since the tapes 22, 24 are adhesively affixed to straps 16, 18, and to portions of the cover 15 which are laterally adjacent to straps 16 and 18, those portions of straps 16, 18 subjacent to the tapes 22, 24 will be positionally restrained against cover member 15—that is to say, the positions of straps 16, 18 subjacent to tapes 22, 24 will remain fixed relative to the cover 15 and thus relative to bale 10. Also, since the bale 10 will be resting upon a rigid surface 11, the weight of the bale 10 will pinch or capture those portions of the straps 16 and 18 along the bottom edge 29. As such, various "safe zones" may be established by means of tapes 22 and/or 24. For example, if only tape 24 is provided on bale 10, then a zone "A" of straps 16 and 18 defined between strap 24 and the bottom edge 29 of bale 10 will be established such that upon severing, outward lashing of tensioned straps 16 and 18 will be minimized. If, on the other hand, only strap 22 is provided, then a relatively larger zone "B" is established between tape 22 and the bottom edge 29 of bale 10. In such a case, tape 22 is principally intended to restrain e.g., straps 18 from lashing outwardly and upwardly over the top of bale 10 and thus potentially striking a person on that side of bale 10 opposite to where the strap was severed. As shown in FIG. 1, a pair of tapes 22, 24 may be provided and, in such a situation, not only is zone "A" defined between the lower tape 24 and the bottom edge 29 of bale 10, but also a similar zone "C" is defined between tapes 22 and 24.

Figure 2:
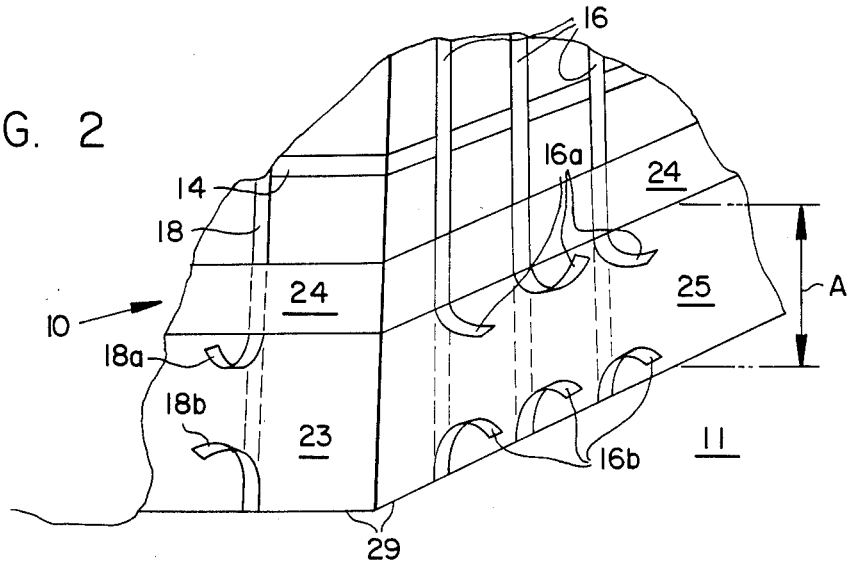
FIG. 2 is a detailed perspective view of a portion of the bale showing the tensioned straps after severing.

The effect of tapes 22 and/or 24 in accordance with the present invention is schematically depicted in accompanying FIG. 2 (with only tape 24 being shown as representative of the functional features of tape 22 also). As is seen, when the vertical portions of straps 16 and 18 are severed within zone "A", the ends 16*a*, 16*b* and 18*a*, 18*b* of straps 16 and 18, respectively, formed upon severing will lash outwardly in opposite directions relative to one another. Such a state is shown in FIG. 2 in solid line. However, ends 16*b* and 18*b* are restrained along bottom edge 29 against support surface 11 by virtue of the weight of bale 10 bearing against support surface 11. The upper ends 16*a* and 18*a* of strap 16 and 18, respectively, are similarly restrained by means of tape 24. Thus, straps 16 and 18 can be severed at any position within zone "A" defined between tape 24 and bottom edge 29 so that outward lashing motion of strap ends 16*a*, 16*b*, and 18*a*, 18*b* will be restrained and minimized upon severing. In a similar manner, the bands 16 and 18 can be severed in the safe zones "B" and "C" respectively defined between tape 22 and bottom edge 29 and between tape 22 and tape 24 as discussed previously.

Figure 3:
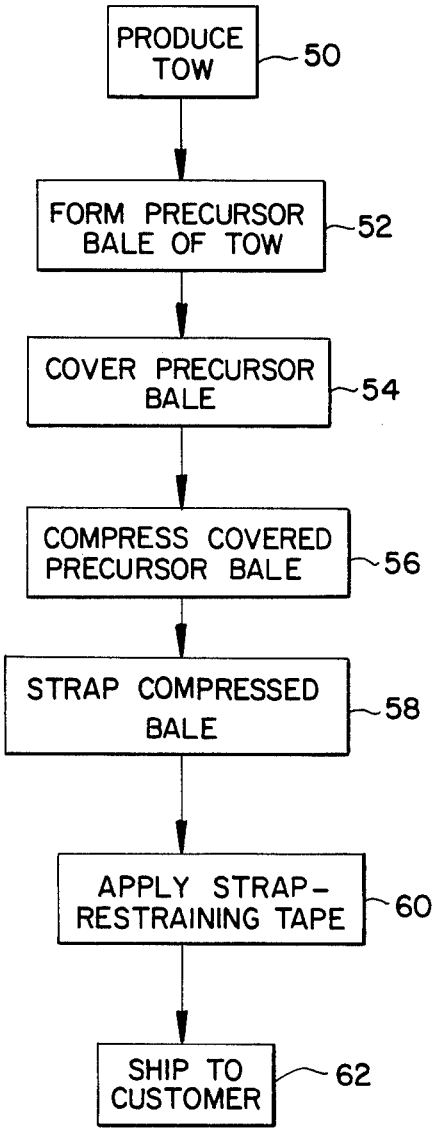
FIG. 3 is a schematic representation of the process for forming the bale of the invention.

FIG. 3 is a schematic representation of the steps utilized to form bale 10 of the present invention. As is conventional, a filamentary tow is produced in step 50 such as, by extruding a polymer solution through spinnerettes and then collecting the thus formed filaments into a tow bundle. A quantity of the continuous filamentary tow is then formed into a precursor or uncompressed bale in step 52 and is covered in step 54 with a suitable cover material. The precursor bale is compressed in step 56 by hydraulic pressing apparatus or like means and the thus covered and compressed tow is then strapped in step 58 utilizing girth strap 14 and vertical straps 16, 18. One or more tapes 22 and/or 24 are then circumferentially affixed in step 60 (either manually or via suitable automated equipment) to the cover 15 of bale 10 so that tapes 22 and/or 24 generally extend transversely over the vertical portions of straps 16 and 18 against opposing side pairs 23, 25. The thus strapped bale having the strap-restraining tapes 22 and/or 24 affixed thereto may then be shipped to a customer in step 62 so that upon severing of the straps 16 and 18 at the customer's facility, a greater measure of safety to personnel is achieved.

While the present invention has been herein described in what is presently conceived to be the most preferred embodiments thereof, those in this art may recognize that many modifications may be made thereof, which modifications shall be accorded the broadest scope of the appended claim so as to encompass all equivalent structures, assemblies and/or methods.

What is claimed is:

1. A bale of compressed textile fibrous material comprising a continuous cover for covering and containing said material, at least one tensioned steel strap encompassing the covered mass and compressing said mass through said cover, and restraining tape generally transversely extending over said at least one steel strap and affixed to said at least one steel strap and to portions of said continuous cover laterally adjacent said at least one steel strap, wherein said restraining tape constitutes the means for attaching said at least one steel strap relative to said bale and for defining a zone of said steel strap adjacent thereto in which said steel strap may be severed to minimize outward lashing thereof.

2. A bale as in claim 1 wherein plural said steel straps encompass respective peripheral surfaces of said bale so that regions of selected ones of said plural steel straps extend vertically against two opposing pairs of vertical sides of said bale when said bale rests upon a rigid support surface, and wherein said restraining tape extends generally horizontally relative to the support surface so as to extend generally transversely over said vertical regions of said selected ones of said plural steel straps, said restraining tape being secured to each said vertical steel strap region and to laterally adjacent portions of each said vertical steel strap region.

3. A bale as in claim 2 wherein said restraining tape horizontally encompasses said bale along its peripheral surface established by said two opposing pairs of vertical sides.

4. A bale as in claim 1 wherein a second restraining tape is provided and is separated from said first-mentioned restraining tape so as to extend generally transversely over said at least one steel strap, said second restraining tape being secured to said at least one strap and to second portions of said continuous cover laterally adjacent to said at least one steep strap, wherein said second tape also constitutes the means for positionally securing said at least one steel strap relative to said bale and for defining a second zone of said at least one steel strap between said second restraining tape and said first-mentioned restraining tape, whereby said at least one steel strap may also be severed in said second zone to minimize outward lashing thereof.

5. A bale as in claim 4 wherein said second restraining tape horizontally encompasses said bale along its peripheral surface established by said two opposing pairs of vertical sides and is vertically separated from and generally parallel to said first-mentioned restraining tape.

6. A bale as in claim 1 wherein said restraining tape is a reinforced adhesive tape which resists tearing forces in its width dimension when said at least one steel strap is severed and wherein said tape is adhesively adhered to said at least one steel strap and to laterally adjacent portions of said continuous cover.

7. In a bale formed of a mass of textile fibrous compressed material having a generally square parallelepiped shape, continuous cover means for covering and containing said textile fibrous compressed material mass, and at least one steel strap means encompassing a peripheral surface of said continuous cover means compressing said mass through said cover means, wherein said steel strap means is maintained under tension by virtue of said mass of textile fibrous compressed material tending to relax against said compressed state, the improvement comprising strap-restraining means generally transversely extending over said steel strap means and fixedly adhering to said steel strap means and to portions of said continuous cover means laterally adjacent to said steel strap means, said strap-restraining means for positionally securing to said continuous cover means that portion of said steel strap means subject to said strap-restraining means and for defining a zone wherein said steel strap means may be severed, such that upon severing of said steel strap means within said zone, said strap-restraining means minimized outward lashing of said steel strap means which would otherwise occur due to release of said tension of said steel strap means upon severing thereof.

8. In a method of forming a bale including the steps of covering a textile fibrous compressed mass with a continuous cover material, compressing the covered textile fibrous mass to form a generally square parallelepiped shape, encompassing a peripheral surface of said covered textile fibrous mass with at least one steel tensioned strap to compress said mass through said cover the improvement comprising the steps of positionally securing said steel strap relative to said bale by transversely extending a tape over said steel strap and adhering said tape to said steel strap and to portions of said continuous cover laterally adjacent to said steel strap, and defining, by means of said tape, a zone in which said steel strap may be safely severed such that said tape restrains said steel strap from outward lashing to an extent which minimizes the risk of injury to a person who severs the steel strap.

9. In a method as in claim 8, the improvement further comprising transversely extending a second tape over said steel strap and adhering said second tape to said steel strap and to second portions of said continuous cover laterally adjacent to said steel strap.

10. In a method as in claim 8, wherein said second tape is substantially parallel to and separated from said first-mentioned tape.

* * * * *